US011569557B2

(12) United States Patent
Tang et al.

(10) Patent No.: US 11,569,557 B2
(45) Date of Patent: Jan. 31, 2023

(54) SUBSTRATE INTEGRATED WAVEGUIDE FILTER COMPRISING AN ELECTRIC FIELD RESPONSIVE DIELECTRIC LAYER CONFIGURED TO ADJUST A FREQUENCY OF THE FILTER

(71) Applicants: Beijing BOE Sensor Technology Co., Ltd., Beijing (CN); BOE Technology Group Co., Ltd., Beijing (CN)

(72) Inventors: Cuiwei Tang, Beijing (CN); Tienlun Ting, Beijing (CN); Ying Wang, Beijing (CN); Jie Wu, Beijing (CN); Haocheng Jia, Beijing (CN); Liang Li, Beijing (CN); Qiangqiang Li, Beijing (CN); Wei Zhang, Beijing (CN); Meng Wei, Beijing (CN); Chuncheng Che, Beijing (CN)

(73) Assignees: BEIJING BOE SENSOR TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/332,539

(22) Filed: May 27, 2021

(65) Prior Publication Data

US 2022/0077554 A1 Mar. 10, 2022

(30) Foreign Application Priority Data

Sep. 4, 2020 (CN) ..... 202010922666.8

(51) Int. Cl.
*H01P 1/208* (2006.01)
*H01P 1/20* (2006.01)
(Continued)

(52) U.S. Cl.
CPC ..... *H01P 1/2088* (2013.01); *H01P 1/2002* (2013.01); *H01P 11/006* (2013.01); *H01P 11/007* (2013.01); *H01Q 1/2283* (2013.01)

(58) Field of Classification Search
CPC ..... H01P 1/2088; H01P 7/065; H01P 7/088
(Continued)

(56) References Cited

U.S. PATENT DOCUMENTS

2004/0041663 A1* 3/2004 Uchimura et al. ..... H01P 3/121 333/135
2010/0019865 A1* 1/2010 Baron et al. ..... H01P 1/18 333/188
2014/0240058 A1* 8/2014 Huang et al. ..... H01P 1/2088 333/135

* cited by examiner

*Primary Examiner* — Benny T Lee
(74) *Attorney, Agent, or Firm* — Nath, Goldberg & Meyer; Joshua B. Goldberg

(57) ABSTRACT

There is provided a substrate integrated waveguide filter having a central region and a peripheral region surrounding the central region, and including: a first substrate; a second substrate opposite to the first substrate; a plurality of conductive support pillars between the first substrate and the second substrate, within the peripheral region, and surrounding the central region, wherein a distance between at least one pair of adjacent two of the plurality of conductive support pillars is less than a wavelength of an electromagnetic wave to be transmitted by the substrate integrated waveguide filter; and a dielectric layer between the first substrate and the second substrate, wherein a permittivity of the dielectric layer is configured to be changed as a strength of an electric field formed between the first substrate and the second substrate is changed to adjust a frequency of the substrate integrated waveguide filter.

20 Claims, 5 Drawing Sheets

(51) Int. Cl.
*H01Q 1/22* (2006.01)
*H01P 11/00* (2006.01)

(58) Field of Classification Search
USPC ..... 333/208
See application file for complete search history.

SUBSTRATE INTEGRATED WAVEGUIDE FILTER COMPRISING AN ELECTRIC FIELD RESPONSIVE DIELECTRIC LAYER CONFIGURED TO ADJUST A FREQUENCY OF THE FILTER

CROSS REFERENCE TO RELATED APPLICATIONS

The present application claims the priority of Chinese patent application No. 202010922666.8, filed on Sep. 4, 2020, the content of which is hereby incorporated herein by reference in its entirety.

TECHNICAL FIELD

The present disclosure relates to the field of waveguide filter technologies, and in particular to a substrate integrated waveguide filter and an antenna device.

BACKGROUND

A substrate integrated waveguide filter generally includes a dielectric substrate and metal layers respectively arranged on an upper side and a lower side of the dielectric substrate. Further, a plurality of metal through holes are periodically arranged in a peripheral region of the dielectric substrate, and penetrate through the dielectric substrate to connect the metal layers respectively on the upper and lower sides to each other, such that the metal through holes and the metal layers respectively on the upper and lower sides form a rectangular waveguide resonant cavity, and an electromagnetic wave may be transmitted in a space of the resonant cavity. However, in the related art, it is difficult to manufacture a filter having an adjustable frequency, or it is difficult to adjust a frequency of a filter by using a mechanical adjustment (e.g., screw adjustment) method.

SUMMARY

Some embodiments of the present disclosure provide a substrate integrated waveguide filter, an antenna device, and a display device.

A first aspect of the present disclosure provides a substrate integrated waveguide filter, which has a central region and a peripheral region surrounding the central region, and includes:

a first substrate;

a second substrate opposite to the first substrate;

a plurality of conductive support pillars between the first substrate and the second substrate, within the peripheral region, and surrounding the central region, wherein a pattern formed by the plurality of conductive support pillars in a plan view includes a first opening and a second opening, the plurality of conductive support pillars are all located outside both the first opening and the second opening, the first opening serves as an input opening of an electromagnetic wave to be transmitted by the substrate integrated waveguide filter, the second opening serves as an output opening of the electromagnetic wave, a distance between two conductive support pillars, which are located on both sides of the first opening, among the plurality of conductive support pillars is a first distance, a distance between two conductive support pillars, which are located on both sides of the second opening, among the plurality of conductive support pillars is a second distance, and a distance between any adjacent two of the plurality of conductive support pillars different from both the first distance and the second distance is less than a wavelength of the electromagnetic wave; and a dielectric layer between the first substrate and the second substrate, wherein a permittivity of the dielectric layer is configured to be changed as a strength of an electric field formed between the first substrate and the second substrate is changed to adjust a frequency of the substrate integrated waveguide filter.

In an embodiment, each of the first distance and the second distance is greater than the wavelength of the electromagnetic wave.

In an embodiment, the first substrate includes a first base plate and a first conductive layer on a side of the first base plate proximal to the second substrate; and the second substrate includes a second base plate and a second conductive layer on a side of the second base plate proximal to the first substrate.

In an embodiment, the first conductive layer has a plurality of hollowed-out portions therein, and each of the plurality of hollowed-out portions has a first insulating structure therein, such that a plurality of first insulating structures are in one-to-one correspondence with the plurality of conductive support pillars; and/or the second conductive layer has a plurality of hollowed-out portions therein, and each of the plurality of hollowed-out portions has a second insulating structure therein, such that a plurality of second insulating structures are in one-to-one correspondence with the plurality of conductive support pillars.

In an embodiment, one end of each conductive support pillar is connected to a corresponding first insulating structure, and the corresponding first insulating structure insulates the conductive support pillar and the first conductive layer from each other; and/or the other end of each conductive support pillar is connected to a corresponding second insulating structure, and the corresponding second insulating structure insulates the conductive support pillar and the second conductive layer from each other.

In an embodiment, the dielectric layer includes a plurality of liquid crystal molecules.

In an embodiment, the substrate integrated waveguide filter further includes: at least one additional conductive support pillar between the first substrate and the second substrate and within the central region.

In an embodiment, the substrate integrated waveguide filter further includes: one additional conductive support pillar between the first substrate and the second substrate and at a center of the central region.

In an embodiment, each of the plurality of conductive support pillars includes a main body and a conductive cladding on a periphery of the main body; and a density of a material of the main body is less than a density of a material of the conductive cladding.

In an embodiment, the material of the main body includes a resin, and the material of the conductive cladding includes a metal.

In an embodiment, the first base plate and the first conductive layer include a same conductive material and have a one-piece structure; and/or the second base plate and the second conductive layer include a same material and have a one-piece structure.

In an embodiment, each of the first base plate and the second base plate is a glass base plate; and each of the first conductive layer and the second conductive layer is a metal conductive layer.

In an embodiment, distances between every pairs of adjacent two of the plurality of conductive support pillars different from both the first distance and the second distance are equal to each other.

In an embodiment, each of the plurality of conductive support pillars is a cylinder having a radius R, and the distance between any adjacent two of the plurality of conductive support pillars different from both the first distance and the second distance is W, where W<4R.

In an embodiment, the pattern is a rectangle, the first opening is in a middle portion of one side of the rectangle, and the second opening is in a middle portion of another side of the rectangle opposite the one side.

In an embodiment, the plurality of conductive support pillars are symmetrically distributed about a line connecting a center of the first opening and a center of the second opening to each other.

In an embodiment, an area of a cross section of the one end, which is in contact with the corresponding first insulating structure, of the conductive support pillar is less than an area of the corresponding first insulating structure; and an area of a cross section of the other end, which is in contact with the corresponding second insulating structure, of the conductive support pillar is less than an area of the corresponding second insulating structure.

In an embodiment, the substrate integrated waveguide filter further includes a sealant, wherein the sealant is between the first and second substrates and surrounds the plurality of conductive support pillars, and is configured to seal the plurality of liquid crystal molecules between the first and second substrates.

A second aspect of the present disclosure provides an antenna device, which includes the substrate integrated waveguide filter according to any one of the embodiments of the first aspect of the present disclosure.

A third aspect of the present disclosure provides a display device, which includes the antenna device according to any one of the embodiments of the second aspect of the present disclosure.

DETAILED DESCRIPTION OF THE INVENTION

Figure 1:
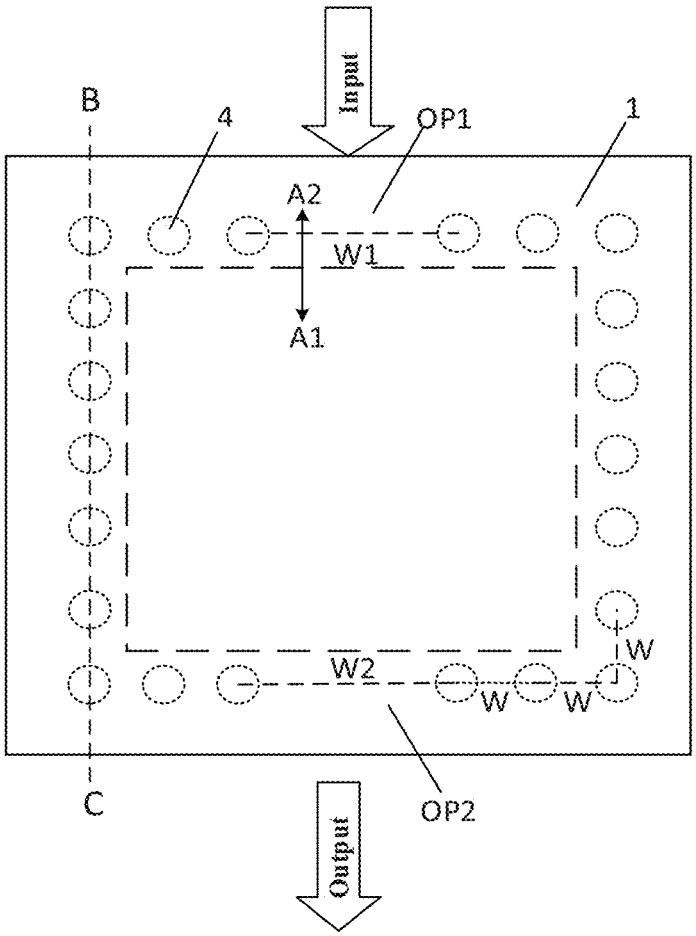
FIG. 1 is a schematic top view of a substrate integrated waveguide filter according to an embodiment of the present disclosure.

To enable one of ordinary skill in the art to better understand technical solutions of the present disclosure, the present disclosure will be further described in detail below with reference to the accompanying drawings and exemplary embodiments.

The shapes and sizes of components shown in the drawings are not necessarily drawn to scale, but are merely for ease understanding the contents of embodiments of the present disclosure.

Unless defined otherwise, technical or scientific terms used herein should have the same meaning as commonly understood by one of ordinary skill in the art to which the present disclosure belongs. The terms of "first", "second", and the like used in the present disclosure are not intended to indicate any order, quantity, or importance, but rather are used for distinguishing one element from another. Also, the term "a", "an", "the", or the like does not denote a limitation of quantity, but rather denote the presence of at least one element. The term of "comprising", "including", or the like, means that the element or item preceding the term contains the element or item listed after the term and its equivalent, but does not exclude the presence of other elements or items. The term "connected", "coupled", and the like are not limited to physical or mechanical connections, but may include electrical connections, whether direct or indirect connections. The terms "upper", "lower", "left", "right", and the like are used only for indicating relative positional relationships, and when the absolute position of the object being described is changed, the relative positional relationships may also be changed accordingly.

As described above, in the related art, it is difficult to manufacture a filter having an adjustable frequency, or it is difficult to adjust a frequency of a filter by using a mechanical adjustment (e.g., screw adjustment) method. Accordingly, in order to solve at least one of technical problems existing in the prior art, some embodiments of the present disclosure provide a substrate integrated waveguide filter, which can adjust a frequency of the substrate integrated waveguide filter by controlling an electric field formed between a first substrate and a second substrate thereof, thereby adjusting the frequency of the substrate integrated waveguide filter more conveniently and rapidly.

Figure 2:
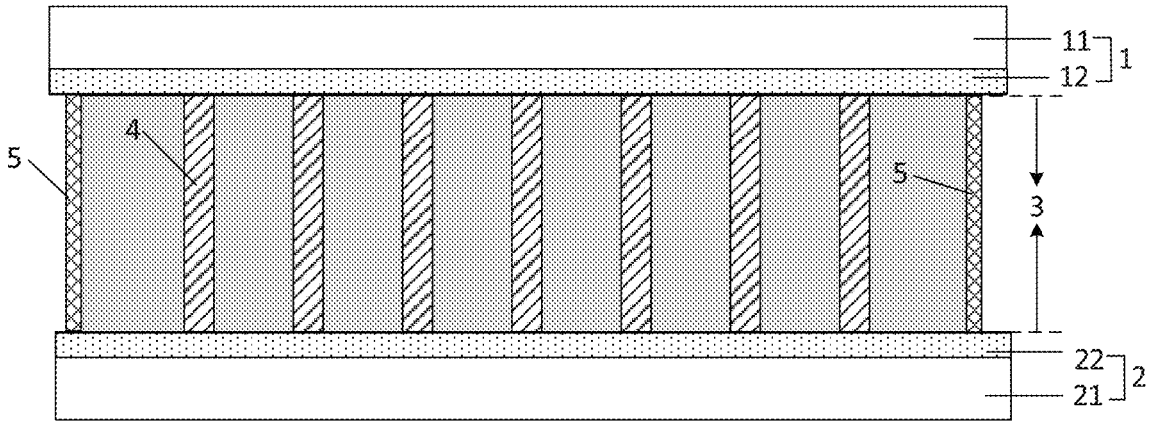
FIG. 2 is a schematic cross-sectional view (e.g., taken along a line B-C shown in FIG. 1) of a substrate integrated waveguide filter according to an embodiment of the present disclosure.

In a first aspect, as shown in FIGS. 1 and 2, the present embodiment provides a substrate integrated waveguide (SIW) filter. FIG. 1 is a schematic top view of the SIW filter according to the present embodiment, and FIG. 2 is a schematic cross-sectional view of the SIW filter shown in FIG. 1 taken along a line B-C. Referring to FIGS. 1 and 2, the SIW filter has a central region A1 and a peripheral region A2 surrounding the central region A1, as shown in FIG. 1, and includes a first substrate 1, a second substrate 2 (FIG. 2), a dielectric layer 3 (FIG. 2), and a plurality of conductive support pillars 4.

For example, referring to FIGS. 1 and 2, the first substrate 1 and the second substrate 2 are disposed opposite to each other, and the dielectric layer 3 is disposed between the first substrate 1 and the second substrate 2, as shown in FIG. 2. The plurality of conductive support pillars 4 are disposed between the first substrate 1 and the second substrate 2, and are disposed around the central region A1 within the peripheral region A2. That is, the plurality of conductive support pillars 4 are arranged in a ring shape that surrounds the central region A1.

Figure 3:
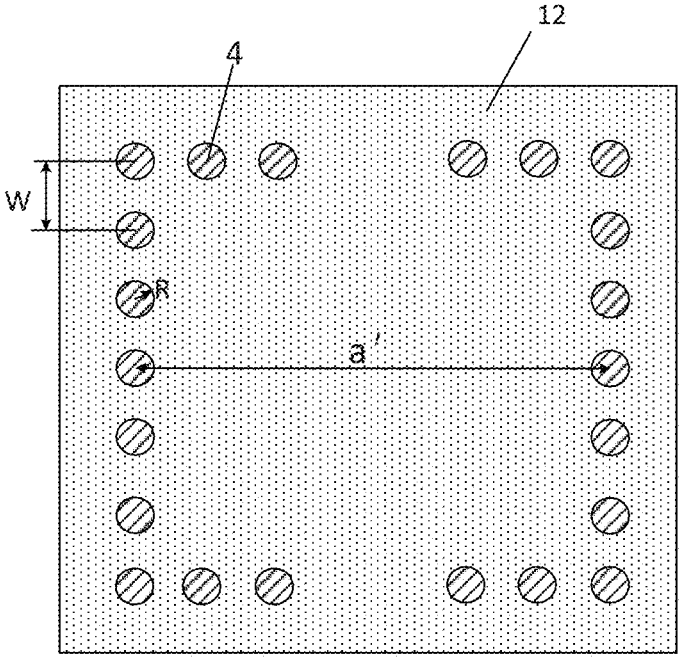
FIG. 3 is a schematic diagram showing structural parameters of a substrate integrated waveguide filter according to an embodiment of the present disclosure.
Figure 4:
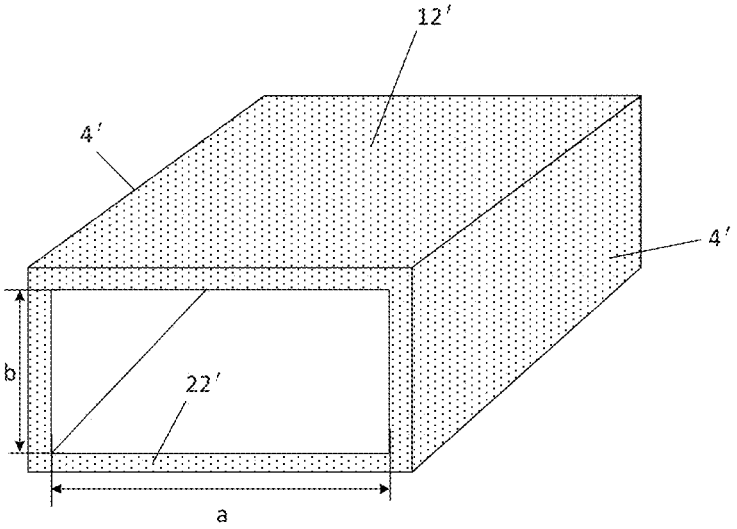
FIG. 4 is a schematic diagram showing a structure of an equivalent rectangular waveguide of a substrate integrated waveguide filter according to an embodiment of the present disclosure.

Further, referring to FIGS. 1-2 and FIGS. 3 and 4, a distance W between any adjacent two of the conductive support pillars 4 may be less than a wavelength of an electromagnetic wave to be transmitted by the SIW filter as shown in FIG. 3, such that the electromagnetic wave cannot pass through a gap between any adjacent two of the conductive support pillars 4. Therefore, the plurality of conductive support pillars 4 arranged in sequence may be regarded as a metal wall, and a surface of the first substrate 1 proximal to the second substrate 2 and a surface of the second substrate 2 proximal to the first substrate 1 are both provided with conductive layers, respectively, as shown in FIG. 2. For example, a first conductive layer 12 (FIGS. 2-3) is provided on a side of the first substrate 1 proximal to the second substrate 2, and a second conductive layer 22 (FIG. 2) is provided on a side of the second substrate 2 proximal to the first substrate 1. Thus, the first conductive layer 12 on the first substrate 1, the second conductive layer 22 on the second substrate 2, and the plurality of conductive support pillars 4 disposed between the first substrate 1 and the second substrate 2 form a rectangular waveguide, as shown in FIG. 4. In the rectangular waveguide shown in FIG. 4, the first conductive layer 12 (FIGS. 2-3) on the first substrate 1 serves as an upper metal wall 12' of the rectangular waveguide, the second conductive layer 22 on the second substrate 2 serves as a lower metal wall 22' of the rectangular waveguide, and the plurality of conductive support pillars 4 located in the peripheral region A2 (FIG. 1) serve as a side wall 4' of the rectangular waveguide. Thus, the first conductive layer 12, the second conductive layer 22, and the plurality of conductive support pillars 4 as the side wall define a boundary of the rectangular waveguide, i.e., define a resonant cavity of the rectangular waveguide, such that an electromagnetic wave input to the SIW filter can be propagated only in the resonant cavity of the rectangular waveguide. For example, the electromagnetic wave input to the SIW filter can be propagated only in a space defined by the first conductive layer 12, the second conductive layer 22, and the plurality of conductive support pillars 4 as the side wall, thereby a filtering process is performed on the electromagnetic wave.

Figure 11:
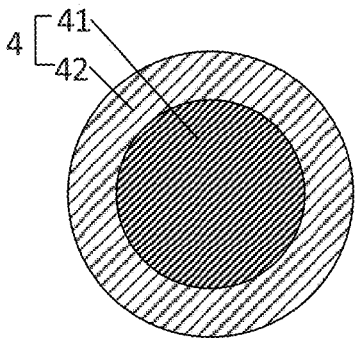
FIG. 11 is a schematic cross-sectional view of the conductive support pillar shown in FIG. 10 taken along a line E-F.

It should be noted that, the distance W between any adjacent two of the conductive support pillars 4 may refer to a distance between centers of circular surfaces (e.g., each of which is a cross section of the conductive support pillar 4 shown in FIG. 11) of any adjacent two of the conductive support pillars 4. Distances W between every pairs of adjacent two of the conductive support pillars 4 may be the same (i.e., equal to each other), i.e., the plurality of conductive support pillars 4 are periodically (or uniformly) arranged in the peripheral region A2. Alternatively, the distances W between every pairs of adjacent two of the conductive support pillars 4 may be different, as long as each distance W is less than the wavelength of the electromagnetic wave to be transmitted in the SIW filter.

For example, referring to FIGS. 1 and 2, some embodiments of the present disclosure provide a SIW filter having a central region A1 and a peripheral region A2 surrounding the central region A1, as shown in FIG. 2. The SIW filter may include: a first substrate 1; a second substrate 2 disposed opposite to the first substrate 1; and a plurality of conductive support pillars 4 disposed between the first substrate 1 and the second substrate 2, as shown in FIG. 1, and disposed around the central region A1 within the peripheral region A2. For example, a pattern (e.g., a rectangle, a ring, etc.) formed by the plurality of conductive support pillars 4 in a plan view (e.g., the plan view shown in FIG. 1) includes a first opening OP1 and a second opening OP2, and the plurality of conductive support pillars 4 are all located outside both the first opening OP1 and the second opening OP2. The first opening OP1 serves as an input opening (which may also be referred to as an input port) for an electromagnetic wave to be transmitted by the SIW filter, and the second opening OP2 serves as an output opening (which may also be referred to as an output port) for the electromagnetic wave. A distance between two conductive support pillars 4, which are located at both sides of the first opening OP1, among the plurality of conductive support pillars 4 is a first distance W1, a distance between two conductive support pillars 4, which are located at both sides of the second opening OP2, among the plurality of conductive support pillars 4 is a second distance W2, and a distance (which may also be referred to as a third distance) W between any adjacent two of the conductive support pillars 4 different from (i.e., except) both the first distance W1 and the second distance W2 is less than the wavelength of the electromagnetic wave. The SIW filter may further include a dielectric layer 3 disposed between the first substrate 1 and the second substrate 2, and a permittivity (i.e., a dielectric constant) of the dielectric layer 3 is changed as a strength of an electric field formed between the first substrate 1 and the second substrate 2 is changed, to adjust a frequency of the SIW filter.

As shown in FIG. 1, the SIW filter has the input opening and the output opening, and the plurality of conductive support pillars 4 sequentially arranged in the peripheral region A2 around the central region A1 are all outside both the input opening and the output opening (i.e., a metal side wall formed by the plurality of conductive support pillars 4 has the first opening OP1 and the second opening OP2 at the positions of the input opening and the output opening, respectively). An electromagnetic wave signal may be input to the SIW filter through the input opening (i.e., may enter the resonant cavity of the rectangular waveguide formed by the first substrate 1, the second substrate 2, and the plurality of conductive support pillars 4 in the peripheral region A2) to be filtered, and then the filtered electromagnetic wave signal is output from the output opening. The SIW filter can separate frequencies from each other, i.e., electromagnetic wave signals having frequencies within a preset frequency range (or a preset wavelength range, any wavelength within the wavelength range is less than a width of the input opening (i.e., the first distance W1) or a width of the output opening (i.e., the second distance W2)) can pass through the SIW filter and be output from the output opening of the SIW filter, while an electromagnetic wave signal having a frequency outside the preset frequency range cannot pass through the SIW filter, thereby effectively implementing a filtering function of the SIW filter. In an embodiment, the second distance W2 may be equal to the first distance W1, and each of the first distance W1 and the second distance W2 may be greater than the wavelength of the electromagnetic wave such that the electromagnetic wave can be input (as indicated by the arrow labeled with "Input" in FIGS. 1 and 7) to the SIW filter through the input opening and output (as indicated by the arrow labeled with "Output" in FIGS. 1 and 7) from the SIW filter to the exterior through the output opening.

Further, as shown in FIGS. 1 and 2, the dielectric layer 3 of the SIW filter is located between the first substrate 1 and the second substrate 2, and the plurality of conductive support pillars 4 are disposed in the dielectric layer 3. That is, the dielectric layer 3 is filled in the resonant cavity of the rectangular waveguide formed by the first substrate 1, the second substrate 2, and the plurality of conductive support pillars 4 in the peripheral region A2. An electromagnetic wave signal may be input into the resonant cavity of the rectangular waveguide from the input opening of the SIW filter, transmitted in the dielectric layer 3, and output through the output opening. As shown in FIG. 2, the surface of the first substrate 1 proximal to the second substrate 2 has the first conductive layer 12 provided thereon, and the surface of the second substrate 2 proximal to the first substrate 1 has the second conductive layer 22 provided thereon. If an external power supply applies a voltage difference across the first conductive layer 12 on the first substrate 1 and the second conductive layer 22 on the second substrate 2, an electric field may be formed between the first substrate 1 and the second substrate 2. The strength of the electric field formed between the first substrate 1 and the second substrate 2 may be changed by controlling a magnitude of the applied voltage difference, and thus the permittivity of the dielectric layer 3 may be changed. In this way, the wavelength of the electromagnetic wave signal propagating in the dielectric layer 3 is changed, and adjustment of the frequency of the SIW filter is achieved. In other words, the permittivity of the dielectric layer 3 may be changed as the strength of the electric field formed between the first substrate 1 and the second substrate 2 is changed.

In summary, in the SIW filter according to the present embodiment, the ring shape formed by the plurality of conductive support pillars 4 located within the peripheral region A2 surrounds the central region A1, the plurality of conductive support pillars 4 are disposed between the first substrate 1 and the second substrate 2, and the distance W between any adjacent two conductive support pillars 4 in a portion of the ring shape except for both the input opening (i.e., the first opening OP1) and the output opening (i.e., the second opening OP2) is less than the wavelength of the electromagnetic wave to be transmitted by the SIW filter. As such, the plurality of conductive support pillars 4 can form a metal wall in the peripheral region A2, and form the rectangular waveguide with the first conductive layer 12 on the first substrate 1 and the second conductive layer 22 on the second substrate 2, to limit a propagation range of the electromagnetic wave signal within the resonant cavity of the rectangular waveguide, thereby implementing the filtering function of the SIW filter. Further, the dielectric layer 3 is provided between the first substrate 1 and the second substrate 2, and the permittivity of the dielectric layer 3 can be changed by the electric field generated between the first substrate 1 and the second substrate 2. Thus, by controlling the voltage difference applied across the first substrate 1 and the second substrate 2, the strength of the electric field formed between the first substrate 1 and the second substrate 2 can be changed, and thus the frequency of the electromagnetic wave propagating in the rectangular waveguide formed in the SIW filter can be changed. That is, the SIW filter that can adjust a frequency more conveniently and rapidly can be realized by changing the voltage difference applied across the first substrate 1 and the second substrate 2.

As described above, the first conductive layer 12 on the first substrate 1, the second conductive layer 22 on the second substrate 2, and the plurality of conductive support pillars 4 disposed between the first substrate 1 and the second substrate 2 form the rectangular waveguide, i.e., a rectangular waveguide as shown in FIG. 4. The first conductive layer 12 on the first substrate 1 serves as the upper metal wall 12' of the rectangular waveguide, the second conductive layer 22 on the second substrate 2 serves as the lower metal wall 22' of the rectangular waveguide, and the plurality of conductive support pillars 4 located in the peripheral region A2 serve as the side walls 4' of the rectangular waveguide. For example, the SIW filter has a first side (e.g., an upper side of FIG. 3 or 4) and a second side (e.g., a lower side of FIG. 3 or 4) opposite to each other, and a third side (e.g., a left side of FIG. 3 or 4) and a fourth side (e.g., a right side of FIG. 3 or 4) opposite to each other. For example, the input opening and the output opening are located at the first side and the second side, respectively. A relationship between a minimum distance a' (FIG. 3) between the conductive support pillars 4 respectively located at the third and fourth sides (e.g., a distance between central axes of two conductive support pillars 4 located on a same straight line in the horizontal direction in FIG. 3) and a width a (as shown in FIG. 4) of the equivalent rectangular waveguide formed by the first conductive layer 12, the second conductive layer 22, and the plurality of conductive support pillars 4 is determined by the following formula:

$$a' = a + \frac{4R^2}{0.95W}$$

where W is the distance between any adjacent two conductive support pillars 4 except both the first distance W1 and the second distance W2, and the "distance" herein is, for example, a distance between centers of circular surfaces (i.e., each of which is the cross section as shown in FIG. 11) of any adjacent two conductive support pillars 4; R is a radius (as shown in FIG. 3) of each of the conductive support pillars 4. Further, a height b (as shown in FIG. 4) of the equivalent rectangular waveguide is a height of each of the conductive support pillars 4.

Further, by controlling a magnitude of the minimum distance a' between the conductive support pillars 4 respectively located at the third and fourth sides, parameters of the SIW filter such as a cut-off wavelength, a cut-off frequency, a wavelength of the equivalent rectangular waveguide shown in FIG. 4, a propagation constant, and the like of the SIW filter can be controlled. For example, a cut-off frequency $f_{eTE10}$ of the SIW filter in the main mode $TE_{10}$ may be calculated according to the following formula:

$$f_{eTE_{10}} = \frac{c_0}{2\sqrt{\varepsilon_r}}\left(a' - \frac{4R^2}{0.95W}\right)^{-1};$$

further, a cut-off frequency $f_{eTE20}$ of the SIW filter in a higher order mode $TE_{20}$ may be calculated according to the following formula:

$$f_{eTE_{20}} = \frac{c_0}{\sqrt{\varepsilon_r}}\left(a' - \frac{4R^2}{1.1W} - \frac{8R^3}{6.6W}\right)^{-1},$$

where $c_0$ is the light velocity, and $\varepsilon_r$ is the permittivity of dielectric layer 3.

Further, the distance W between any adjacent two of the conductive support pillars 4 different from (or except) both the first distance W1 and the second distance W2 is less than the wavelength of the electromagnetic wave to be transmitted in the SIW filter, to ensure that the electromagnetic wave does not leak from the gap between any adjacent two of the conductive support pillars 4. For this purpose, a relationship between the radius R of the circular surface of each of the conductive support pillars 4 and the distance W between any adjacent two of the conductive support pillars 4 different from (or except) both the first distance W1 and the second distance W2 is determined according to the following formulas:

$$R<0.1\lambda_g,\ W<4R,\ R<0$$

where $\lambda_g$ is a wavelength of the equivalent rectangular waveguide shown in FIG. 4, and may be calculated according to the following formula:

$$\lambda_g = \frac{\lambda}{\sqrt{1-\left(\frac{\lambda}{\lambda_c}\right)^2}},$$

where $\lambda_c$ is the cut-off wavelength, and $\lambda$ is the wavelength of the electromagnetic wave to be transmitted by the SIW filter.

Figure 5:
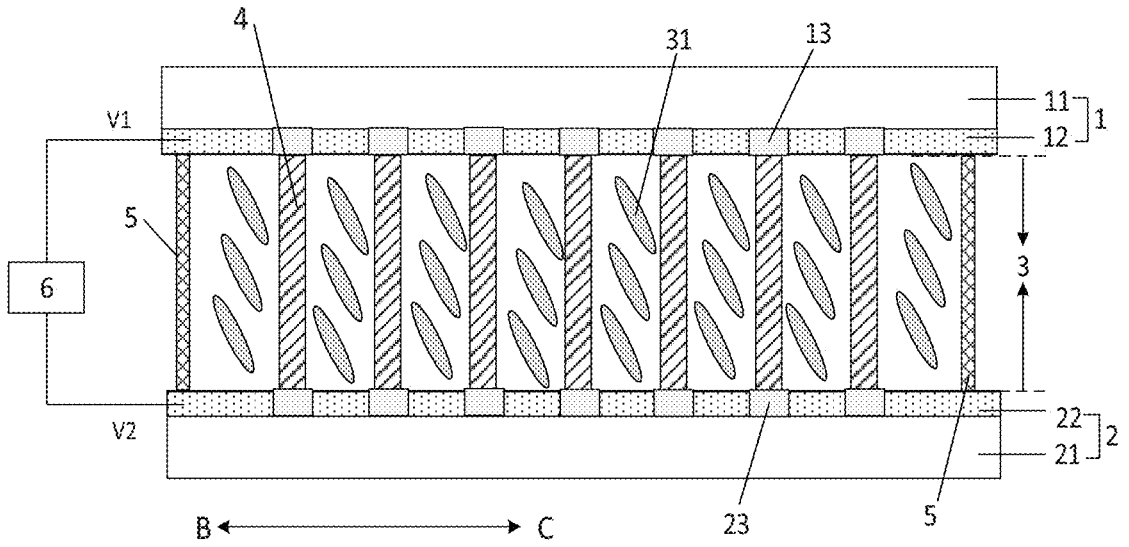
FIG. 5 is a schematic cross-sectional view of a substrate integrated waveguide filter according to an embodiment of the present disclosure (it should be note that, the double arrow B-C shown in FIG. 5 indicates that this cross-sectional view is taken along the line B-C shown in FIG. 1)

Optionally, as shown in FIGS. 2 and 5, the first substrate 1 includes a first base plate 11 and the first conductive layer 12 disposed on a side of the first base plate 11 proximal to the second substrate 2. The second substrate 2 includes a second base plate 21 and the second conductive layer 22 disposed on a side of the second base plate 21 proximal to the first substrate 1. The first conductive layer 12, the second conductive layer 22, and the plurality of conductive support pillars 4 in the peripheral region A2 (FIG. 1) form the rectangular waveguide, and the electric field formed between the first conductive layer 12 and the second conductive layer 22 by applying an external voltage difference across the first conductive layer 12 and the second conductive layer 22 can adjust the permittivity of the dielectric layer 3.

Further, referring to FIG. 5, the dielectric layer 3 may include one of various types of media each having an adjustable permittivity, and each of the media having the adjustable permittivity may be a substance such as a liquid or a solid, as long as the permittivity of the dielectric layer 3 can be controlled by a voltage (e.g., a voltage difference across the first conductive layer 12 and the second conductive layer 22). For example, the dielectric layer 3 includes a plurality of liquid crystal molecules 31, the conductive support pillars 4 support the first substrate 1 and the second substrate 2 such that the first substrate 1 and the second substrate 2 are spaced apart from each other by a certain distance to form an accommodation space, and the plurality of liquid crystal molecules 31 are filled in the accommodation space between the first substrate 1 and the second substrate 2 to form the dielectric layer 3. An external power supply 6 may supply a first voltage V1 to the first conductive layer 12 on the first substrate 1, and may supply a second voltage V2 different from the first voltage V1 to the second conductive layer 22 on the second substrate 2, such that an electric field is generated between the first substrate 1 and the second substrate 2. The electric field generated between the first substrate 1 and the second substrate 2 can control a rotation direction of the plurality of liquid crystal molecules 31, thereby adjusting the permittivity of the dielectric layer 3 formed by the plurality of liquid crystal molecules 31, changing the wavelength of the electromagnetic wave propagating in the dielectric layer 3, and achieving the function of adjusting the frequency of the SIW filter.

Figure 6:
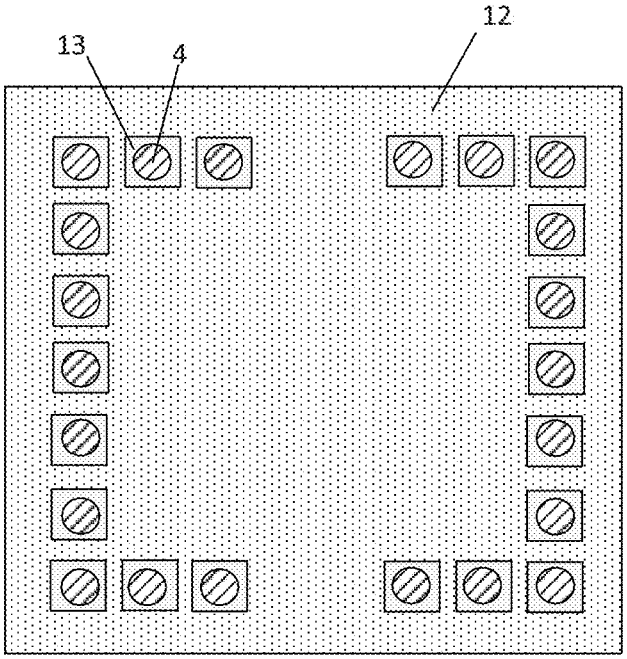
FIG. 6 is a schematic bottom view of a substrate integrated waveguide filter according to an embodiment of the present disclosure.

Further, referring to FIGS. 5 and 6, FIG. 6 is a schematic bottom view of the SIW filter shown in FIG. 5 with the second substrate 2 removed. The external power supply 6 (FIG. 5) can apply the first voltage V1 (FIG. 5) to the first conductive layer 12 and the second voltage V2 (FIG. 5) to the second conductive layer 22 (FIG. 5), and the conductive support pillars 4 disposed between the first conductive layer 12 and the second conductive layer 22 can conduct a voltage. Thus, in order to insulate the first conductive layer 12 from the second conductive layer 22 so as to avoid a short circuit, a portion, which corresponds to (e.g., is in contact with) each conductive support pillar 4, of the first conductive layer 12 needs to be insulated, and/or a portion, which corresponds to (e.g., is in contact with) each conductive support pillar 4, of the second conductive layer 22 needs to be insulated.

For example, referring to FIGS. 5 and 6, the first conductive layer 12 may have a plurality of hollowed-out portions (or openings) therein, and a first insulating structure 13 is disposed in each of the plurality of hollowed-out portions (or each of the openings), such that a plurality of first insulating structures 13 are in one-to-one correspondence with the plurality of conductive support pillars 4, and an area of each first insulating structure 13 is greater than an area of a cross section of an end, which is in contact with the first insulating structure 13, of the corresponding conductive support pillar 4. In this way, it is ensured that each conductive support pillar 4 is insulated from the first conductive layer 12, and each conductive support pillar 4 is prevented from transmitting the first voltage V1 applied to the first conductive layer 12 to the second conductive layer 22. Similarly, the second conductive layer 22 may have a plurality of hollowed-out portions (or openings), and a second insulating structure 23 (FIG. 5) is disposed in each of the plurality of hollowed-out portions (or each of the openings), such that a plurality of second insulating structures 23 are in one-to-one correspondence with the plurality of conductive support pillars 4, and an area of each second insulating structure 23 is greater than an area of a cross section of an end, which is in contact with the second insulating structure 23, of the corresponding conductive support pillar 4. In this way, it is ensured that each conductive support pillar 4 is insulated from the second conductive layer 22, and each conductive support pillar 4 is prevented from transmitting the second voltage V2 applied to the second conductive layer 22 to the first conductive layer 21, as shown in FIG. 5. A top view of the second conductive layer 22 is similar to the bottom view of the first conductive layer 12 shown in FIG. 6, and description thereof is omitted here.

It should be noted that, in order to insulate the first conductive layer 12 from the second conductive layer 22, one of the first conductive layer 12 and the second conductive layer 22 may be provided with the insulating structures, or both of the first conductive layer 12 and the second conductive layer 22 may be provided with the insulating structures (as shown in FIG. 5). If only the first conductive layer 12 is provided with the first insulating structures 13, one end of each conductive support pillar 4 is connected to the corresponding first insulating structure 13 such that the corresponding first insulating structure 13 insulates the conductive support pillar 4 and the first conductive layer 12 from each other, and the other end of the conductive support pillar 4 is connected to the second conductive layer 22. If only the second conductive layer 22 is provided with the second insulating structures 23, the other end of each conductive support pillar 4 is connected to the corresponding second insulating structure 23 such that the corresponding second insulating structure 23 insulates the conductive support pillar 4 and the second conductive layer 22 from each other, and the one end of the conductive support pillar 4 is connected to the first conductive layer 12. If the first conductive layer 12 is provided with the first insulating structures 13 and the second conductive layer 22 is provided with the second insulating structures 23, the one end of each conductive support pillar 4 is connected to the corresponding first insulating structure 13, and the other end of the conductive support pillar 4 is connected to the corresponding second insulating structure 23.

Figure 7:
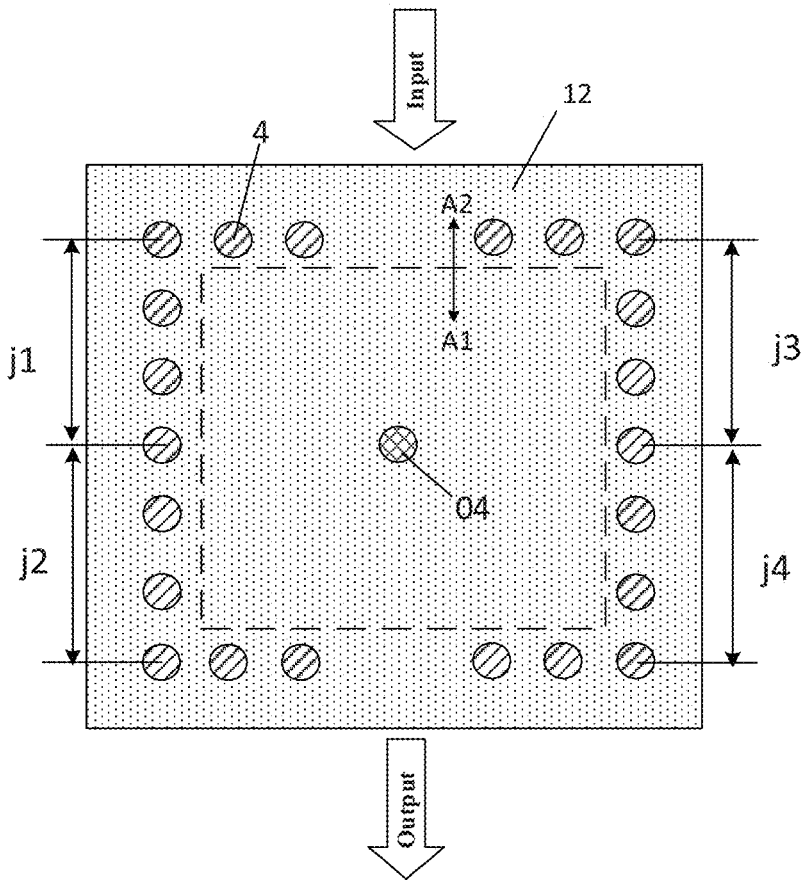
FIG. 7 is a schematic top view of another substrate integrated waveguide filter according to an embodiment of the present disclosure.

As another example, as shown in FIG. 7 in addition to FIGS. 1-6, the SIW filter according to the present embodiment further includes at least one additional conductive support pillar 04 disposed between the first substrate 1 and the second substrate 2. Unlike the plurality of conductive support pillars 4, the at least one additional conductive support pillar 04 is disposed within the central region A1. The plurality of conductive support pillars 4 arranged in sequence within the peripheral region A2 may be regarded as a transmission portion of the SIW filter, and the plurality of conductive support pillars 4 form the rectangular waveguide with the first conductive layer 12 and the second conductive layer 22. An electromagnetic wave may be propagated in the resonant cavity of the rectangular waveguide. While the at least one additional conductive support pillar 04 arranged in the central region may be regarded as a discontinuous part (which may be referred to as a reactance portion) of the SIW filter, and the arrangement of the at least one additional conductive support pillar 04 in the resonant cavity of the rectangular waveguide is equivalent to forming a local reactance at the arrangement position. In the resonant cavity of the rectangular waveguide, a voltage applied to a portion of the resonant cavity, where the at least one additional conductive support pillar 04 is arranged, will be reduced sharply, which is equivalent to forming an additional boundary of the resonant cavity at the arrangement position of the at least one additional conductive support pillar 04, thereby changing a transmission mode of the rectangular waveguide. The number (i.e., quantity) and distribution position of the at least one additional conductive support pillar 04 may be controlled according to the requirements of the SIW filter, such as a size and an operation frequency of the SIW filter, so as to change a boundary condition of the rectangular waveguide formed by the conductive support pillars 4, thereby changing the transmission mode of the SIW filter.

Figure 8:
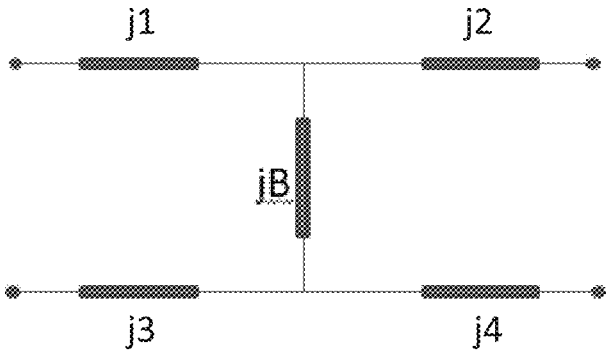
FIG. 8 is a schematic circuit diagram of an equivalent reactance of the substrate integrated waveguide filter shown in FIG. 7.

In the case where the SIW filter further includes one additional conductive support pillar 04, as shown in FIGS. 7 and 8, the additional conductive support pillar 04 may be disposed between the first substrate 1 and the second substrate 2 and at a center of the central region A1 (i.e., at a center of the resonant cavity of the rectangular waveguide formed by the first substrate 1, the second substrate 2 and the plurality of conductive support pillars 4), which is equivalent to forming a central reactance jB (FIG. 8) at the center of the resonant cavity. Further, the conductive support pillars 4 on both sides of a line connecting a center of the input opening and a center of the output opening to each other, with a horizontal straight line passing through the additional conductive support pillar 04 in FIG. 7 as a boundary line, may be equivalent to a first reactance j1, a second reactance j2, a third reactance j3, and a fourth reactance j4, respectively. The first reactance j1 and the second reactance j2 are connected (e.g., connected in series) to each other, and are both connected to the central reactance jB; the third reactance j3 and the fourth reactance j4 are connected (e.g., connected in series) to each other, and are both connected to the central reactance jB, thereby forming a reactance connection structure as shown in FIG. 8. The transmission mode of the SIW filter without the additional conductive support pillar 04 may be a main mode $TE_{10}$, and a higher order mode $TE_{20}$ is localized because the higher order mode $TE_{20}$ is attenuated fast. The effect of the higher order mode $TE_{20}$ relative to the main mode $TE_{10}$ is equivalent to setting a reactance, such that the arrangement of the additional conductive support pillar 04 at the center of the resonant cavity can inhibit the existence of the main mode $TE_{10}$, and the transmission mode of the electromagnetic wave in the resonant cavity can be changed to $TE_{20}$. Alternatively, one or more additional conductive support pillars 04 may be disposed at other positions to form different boundaries of the resonant cavity so as to change the transmission mode of the SIW filter, which may be set according to the requirements of a practical product.

Figure 9:
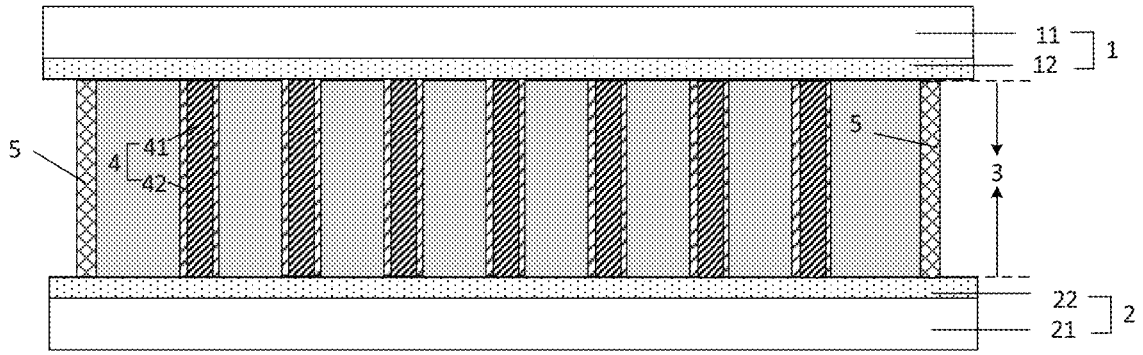
FIG. 9 is a schematic cross-sectional view of a substrate integrated waveguide filter, any one of conductive support pillars of the substrate integrated waveguide filter having a double-layer structure, according to an embodiment of the present disclosure.

As another example, as shown in FIG. 9, the components 1, 2, 3, 11, 12, 21, 22 and 5 shown in FIG. 9 are the same as the components 1, 2, 3, 11, 12, 21, 22 and 5 shown in FIGS. 2 and 5, and each of the conductive support pillars 4 (FIG. 9) may have one of a variety of configurations. For example, each of the conductive support pillars 4 (FIG. 9) includes a main body (which may be referred to as a "pillar" core) 41, and a conductive cladding (or coating) 42 disposed on the periphery of the main body 41. For example, a density of a material of the main body 41 is less than a density of a material of the conductive cladding 42, such that a mass of each of the conductive support pillars 4 (FIG. 9) can be effectively reduced. As such, the conductive cladding 42 on the periphery can ensure the electrically conductive function of each conductive support pillar 4, and does not prevent each conductive support pillar 4 (FIG. 9) from forming the rectangular waveguide with the first conductive layer 12 and the second conductive layer 22, thereby reducing a mass of the whole SIW filter.

For example, a material of the main body 41 or the conductive cladding 42 of each conductive support pillar 4 (FIG. 9) may be at least one of a variety of materials. For example, the material of the main body 41 of each conductive support pillar 4 (FIG. 9) includes a resin which can provide a sufficient supporting force to allow the conductive support pillar 4 (FIG. 9) to be provided between the first substrate 1 and the second substrate 2 and support the first substrate 1 and the second substrate 2 to form the accommodation space. The material of the conductive cladding 42 may include one of various types of metals, such as copper, silver, aluminum, or the like.

Figure 10:
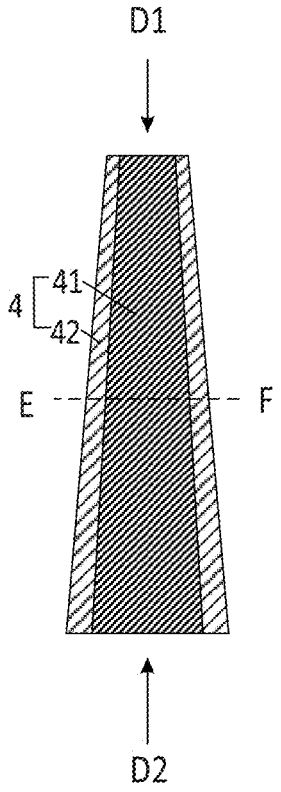
FIG. 10 is a schematic diagram showing a structure of one of conductive support pillars of an substrate integrated waveguide filter according to an embodiment of the present disclosure.

For example, each conductive support pillar 4 (FIG. 9) may be a pillar having one of various shapes, such as a cylinder, a tapered cylinder, or the like. Referring to FIGS. 10 and 11, as an example, each conductive support pillar 4 (FIG. 9) is a tapered cylinder, and FIG. 11 is a schematic cross-sectional view of the conductive support pillar 4 (FIG.

9) taken along a line E-F shown in FIG. 10. Each conductive support pillar 4 (FIG. 9) as the tapered cylinder includes the main body 41 and the conductive cladding 42 on the periphery of the main body 41. An area of a cross section of a first end D1 of the tapered cylinder is less than an area of a cross section of a second end D2 of the tapered cylinder. If each conductive support pillar 4 (FIG. 9) as the tapered cylinder is applied to the SIW filter, and the first insulating structures 13 are provided on the first conductive layer 12 and the second insulating structures 23 are provided on the second conductive layer 22, the first end D1 of each conductive support pillar 4 (FIG. 9) as the tapered cylinder may be connected to the corresponding first insulating structure 13 (FIGS. 5 and 6), and the second end D2 thereof may be connected to the corresponding second insulating structure 23 (FIG. 5). Further, an area of the corresponding first insulating structure 13 is greater than the area of the cross section of the first end D1, and an area of the corresponding second insulating structure 23 is greater than the area of the cross section of the second end D2.

Optionally, in some embodiments as shown in FIGS. 2, 5 and 9, the first substrate 1 includes the first base plate 11 and the first conductive layer 12 disposed on the side of the first base plate 11 proximal to the second substrate 2. The second substrate 2 includes the second base plate 21 and the second conductive layer 22 disposed on the side of the second base plate 21 proximal to the first substrate 1. The first base plate 11 and the first conductive layer 12 may be made of a same conductive material, and may have a one-piece structure, i.e., the entire first substrate 1 is a conductive substrate such as a metal substrate; and/or the second base plate 21 and the second conductive layer 22 may be made of a same conductive material, and may have a one-piece structure, i.e., the entire second substrate 2 is a conductive substrate such as a metal substrate. Alternatively, in some embodiments, both the first base plate 11 and the second base plate 21 are glass base plates, and both the first conductive layer 21 and the second conductive layer 22 are metal conductive layers. As such, a processing precision of the glass base plates is high, and if a precision of the distance W (FIG. 3) between any adjacent two conductive support pillars 4 except both the first distance W1 (FIG. 1) and the second distance W2 (FIG. 1) is high, a manufacturing process for the SIW filter is easier to be performed on the glass base plates, which is advantageous for manufacturing a high-precision SIW filter. Alternatively, each of the first base plate 11 and the second base plate 21 may be a substrate of another type, such as a flexible substrate, a silicon substrate, or the like, which is not limited in an embodiments of the present disclosure.

Further, as shown in FIGS. 1 to 11, in an embodiment, the distances W (FIG. 3) between every pairs of adjacent two of the plurality of conductive support pillars 4 different from (or except) both the first distance W1 (FIG. 1) and the second distance W2 (FIG. 1) may be equal to each other.

In an embodiment, each of the conductive support pillars 4 is a cylinder having a radius R (as shown in FIG. 3), and the distance between any adjacent two of the plurality of conductive support pillars 4 different from (or except) both the first distance W1 (FIG. 1) and the second distance W2 (FIG. 1) is W, where W<4R (i.e., the distance W is less than 4 times the radius R of each conductive support pillar 4 which is a cylinder).

In an embodiment, the pattern formed by the plurality of conductive support pillars 4 is a rectangle, the first opening OP1 is located in a middle portion of one side (e.g., an upper side as shown in FIG. 1) of the rectangle, and the second opening OP2 is located in a middle portion of another side (e.g., a lower side as shown in FIG. 1) of the rectangle opposite to the one side.

In an embodiment, the plurality of conductive support pillars 4 are symmetrically distributed about a line connecting a center of the first opening OP1 and a center of the second opening OP2 to each other (i.e., a vertical central axis of the plan view shown in FIG. 1).

In an embodiment, the area of the cross section of the one end of each conductive support pillar 4 in contact with the corresponding first insulating structure 13 (e.g., the upper end of the conductive support pillar 4 as shown in FIG. 5) is less than the area of the corresponding first insulating structure 13, and the area of the cross section of the other end of the conductive support pillar 4 in contact with the corresponding second insulating structure 23 (e.g., the lower end of the conductive support pillar 4 as shown in FIG. 5) is less than the area of the corresponding second insulating structure 23.

In an embodiment, the SIW filter further includes a sealant 5 (as shown in FIGS. 2, 5 and 9). The sealant 5 is positioned between the first substrate 1 and the second substrate 2 and surrounds the plurality of conductive support pillars 4, and seals the plurality of liquid crystal molecules 31 (FIG. 5) between the first substrate 1 and the second substrate 2.

In a second aspect, an embodiment of the present disclosure provides an antenna device (which may be simply referred to as an "antenna"), which includes the SIW filter described in any one of the foregoing embodiments, and further includes an antenna structure. The antenna structure may transmit a radio frequency signal, and the radio frequency signal is filtered by the SIW filter and then transmitted back to the antenna structure so as to be transmitted to the exterior of the SIW filter. The antenna device may include various types of antennas, and is not limited herein.

In a third aspect, an embodiment of the present disclosure provides a display device, which includes the antenna device described above, so as to implement a communication function. In addition, the display device may further include a conventional display panel and a conventional touch panel. It should be noted that the display device according to the present embodiment may be any product or component with a display function, such as a mobile phone, a tablet computer, a television, a monitor, a notebook computer, a digital photo frame, a navigator, or the like. Other optional components of the display device may be selected by one of ordinary skill in the art according to the requirements of a practical product, and are not described in detail herein, nor should they be construed as limiting the present disclosure.

It should be understood that the above embodiments are merely exemplary embodiments adopted to explain the principles of the present disclosure, and the present disclosure is not limited thereto. It will be apparent to one of ordinary skill in the art that various changes and modifications may be made therein without departing from the spirit and scope of the present disclosure, and these changes and modifications also fall within the scope of the present disclosure.

What is claimed is:

1. A substrate integrated waveguide filter, having a central region and a peripheral region surrounding the central region, and comprising:

a first substrate;

a second substrate opposite to the first substrate;

a plurality of conductive support pillars between the first substrate and the second substrate, within the peripheral region, and surrounding the central region, wherein a pattern formed by the plurality of conductive support pillars in a plan view comprises a first opening and a second opening, the plurality of conductive support pillars are all located outside both the first opening and the second opening, the first opening serves as an input opening for an electromagnetic wave to be transmitted by the substrate integrated waveguide filter, the second opening serves as an output opening for the electromagnetic wave, a distance between two conductive support pillars, which are located on both sides of the first opening, among the plurality of conductive support pillars is a first distance, a distance between two conductive support pillars, which are located on both sides of the second opening, among the plurality of conductive support pillars is a second distance, a distance between any adjacent two of the plurality of conductive support pillars is different from both the first distance and the second distance, and is less than a wavelength of the electromagnetic wave; and a dielectric layer disposed between the first substrate and the second substrate, wherein a permittivity of the dielectric layer is configured to be changed as a strength of an electric field applied between the first substrate and the second substrate is changed to adjust a frequency of the substrate integrated waveguide filter, wherein each of the first distance and the second distance is greater than the wavelength of the electromagnetic wave.

2. The substrate integrated waveguide filter according to claim 1, wherein the first substrate comprises a first base plate and a first conductive layer on a side of the first base plate proximal to the second substrate; and the second substrate comprises a second base plate and a second conductive layer on a side of the second base plate proximal to the first substrate.

3. The substrate integrated waveguide filter according to claim 2, wherein the first base plate and the first conductive layer comprise a same conductive material and have a one-piece structure; and/or the second base plate and the second conductive layer comprise a same material and have a one-piece structure.

4. The substrate integrated waveguide filter according to claim 2, wherein the first conductive layer has a plurality of hollowed-out portions therein, and each of the plurality of hollowed-out portions has a first insulating structure therein, such that a plurality of first insulating structures are in one-to-one correspondence with the plurality of conductive support pillars; and/or the second conductive layer has a plurality of hollowed-out portions therein, and each of the plurality of hollowed-out portions of the second conductive layer has a second insulating structure therein, such that a plurality of second insulating structures are in one-to-one correspondence with the plurality of conductive support pillars.

5. The substrate integrated waveguide filter according to claim 4, wherein a first end of each conductive support pillar is connected to a corresponding first insulating structure, and the corresponding first insulating structure insulates the corresponding conductive support pillar and the first conductive layer from each other; and/or a second end of each conductive support pillar is connected to a corresponding second insulating structure, and the corresponding second insulating structure insulates the corresponding conductive support pillar and the second conductive layer from each other.

6. The substrate integrated waveguide filter according to claim 5, wherein an area of a cross section of the first end, which is in contact with the corresponding first insulating structure, of the corresponding conductive support pillar is less than an area of the corresponding first insulating structure; and an area of a cross section of the second end, which is in contact with the corresponding second insulating structure, of the corresponding conductive support pillar is less than an area of the corresponding second insulating structure.

7. The substrate integrated waveguide filter according to claim 2, wherein each of the first base plate and the second base plate is a glass base plate; and each of the first conductive layer and the second conductive layer is a corresponding metal conductive layer.

8. The substrate integrated waveguide filter according to claim 1, further comprising: one additional conductive support pillar disposed between the first substrate and the second substrate and at a center of the central region.

9. The substrate integrated waveguide filter according to claim 1, further comprising: at least one additional conductive support pillar disposed between the first substrate and the second substrate and within the central region.

10. The substrate integrated waveguide filter according to claim 1, wherein the plurality of conductive support pillars are symmetrically distributed about a line connecting a center of the first opening and a center of the second opening to each other.

11. The substrate integrated waveguide filter according to claim 1, wherein the dielectric layer comprises a plurality of liquid crystal molecules.

12. The substrate integrated waveguide filter according to claim 11, further comprising a sealant, wherein the sealant is disposed between the first and second substrates and surrounds the plurality of conductive support pillars, and is configured to seal the plurality of liquid crystal molecules between the first and second substrates.

13. The substrate integrated waveguide filter according to claim 1, wherein a distance between any adjacent two of the plurality of conductive support pillars different from both the first distance and the second distance is constant.

14. The substrate integrated waveguide filter according to claim 1, wherein each of the plurality of conductive support pillars is a cylinder having a radius R, and the distance between any adjacent two of the plurality of conductive support pillars different from both the first distance and the second distance is W, where $W<4R$.

15. The substrate integrated waveguide filter according to claim 1, wherein the pattern is a rectangle, the first opening is in a middle portion of one side of the rectangle, and the second opening is in a middle portion of another side of the rectangle opposite the one side.

16. A substrate integrated waveguide filter, having a central region and a peripheral region surrounding the central region, and comprising:

a first substrate;

a second substrate opposite to the first substrate;

a plurality of conductive support pillars between the first substrate and the second substrate, within the peripheral region, and surrounding the central region, wherein a pattern formed by the plurality of conductive support pillars in a plan view comprises a first opening and a second opening, the plurality of conductive support pillars are all located outside both the first opening and the second opening, the first opening serves as an input opening for an electromagnetic wave to be transmitted by the substrate integrated waveguide filter, the second opening serves as an output opening for the electromagnetic wave, a distance between two conductive support pillars, which are located on both sides of the first opening, among the plurality of conductive support pillars is a first distance, a distance between two conductive support pillars, which are located on both sides of the second opening, among the plurality of conductive support pillars is a second distance, a distance between any adjacent two of the plurality of conductive support pillars is different from both the first distance and the second distance, and is less than a wavelength of the electromagnetic wave;

a dielectric layer disposed between the first substrate and the second substrate, wherein a permittivity of the dielectric layer is configured to be changed as a strength of an electric field applied between the first substrate and the second substrate is changed to adjust a frequency of the substrate integrated waveguide filter; and at least one additional conductive support pillar disposed between the first substrate and the second substrate and within the central region.

17. The substrate integrated waveguide filter according to claim 16, wherein each of the first distance and the second distance is greater than the wavelength of the electromagnetic wave.

18. A substrate integrated waveguide filter, having a central region and a peripheral region surrounding the central region, and comprising:

a first substrate;

a second substrate opposite to the first substrate;

a plurality of conductive support pillars between the first substrate and the second substrate, within the peripheral region, and surrounding the central region, wherein a pattern formed by the plurality of conductive support pillars in a plan view comprises a first opening and a second opening, the plurality of conductive support pillars are all located outside both the first opening and the second opening, the first opening serves as an input opening for an electromagnetic wave to be transmitted by the substrate integrated waveguide filter, the second opening serves as an output opening for the electromagnetic wave, a distance between two conductive support pillars, which are located on both sides of the first opening, among the plurality of conductive support pillars is a first distance, a distance between two conductive support pillars, which are located on both sides of the second opening, among the plurality of conductive support pillars is a second distance, a distance between any adjacent two of the plurality of conductive support pillars is different from both the first distance and the second distance, and is less than a wavelength of the electromagnetic wave; and a dielectric layer disposed between the first substrate and the second substrate, wherein a permittivity of the dielectric layer is configured to be changed as a strength of an electric field applied between the first substrate and the second substrate is changed to adjust a frequency of the substrate integrated waveguide filter, wherein each of the plurality of conductive support pillars comprises a corresponding main body and a corresponding conductive cladding on a periphery of the corresponding main body; and a density of a material of the corresponding main body is less than a density of a material of the corresponding conductive cladding.

19. The substrate integrated waveguide filter according to claim 18, wherein each of the first distance and the second distance is greater than the wavelength of the electromagnetic wave.

20. The substrate integrated waveguide filter according to claim 18, wherein the material of the corresponding main body comprises a resin, and the material of the corresponding conductive cladding comprises a metal.

* * * * *